United States Patent [19]

Jonkers

[11] Patent Number: 4,828,129

[45] Date of Patent: May 9, 1989

[54] VENTING COVER

[76] Inventor: Godefridus H. J. Jonkers, 64 Helmondselaan, 5702 NN Helmond, Netherlands

[21] Appl. No.: 163,713

[22] Filed: Mar. 3, 1988

[30] Foreign Application Priority Data

Mar. 6, 1987 [NL] Netherlands ..... 8700550

[51] Int. Cl.[4] ..... B65D 51/16

[52] U.S. Cl. ..... 215/260

[58] Field of Search ..... 215/260; 220/209, 208

[56] References Cited

U.S. PATENT DOCUMENTS 3,913,781 10/1975 Andreux ..... 215/260 X 3,918,606 11/1975 Keller ..... 220/209 X 3,976,216 8/1976 Lambert ..... 215/260 X

*Primary Examiner*—Donald F. Norton

*Attorney, Agent, or Firm*—John P. Snyder

[57] ABSTRACT

A cover for a filling or dispenser spout (5) for a storage holder such as a liquid container, which cover consists of a circular body (1) having arranged along the periphery thereof a flange member (2) provided with fastening means (3) such as a screw-thread, co-operating with the spout (5) and a sealing ring (7) fitted inside the flange member, wherein the circular part of the cover located inside the sealing ring is provided with a discharge opening (8) which can be closed off from the container content by a pressure sensitive closing means (9) arranged inside the cover, said closing means being a dome-like structure (13) co-operating with a diaphragm (10) with a passage opening (12), such that the content of a storage holder can be vented without the content thereof, for instance an aggressive liquid, being able to escape to the outside.

10 Claims, 1 Drawing Sheet

VENTING COVER

Figure 1:
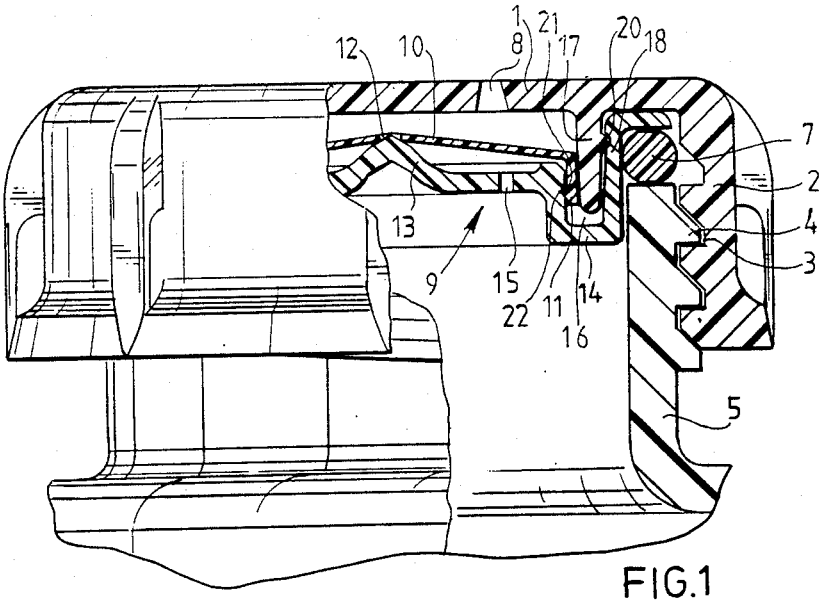

The invention relates to a cover for a filling or dispenser spout for a storage holder such as a liquid container, which covers consists of a circular body having arranged along the periphery thereof a flange member provided with fastening means, such as a screw thread, co-operating with the spout, and a sealing ring fitted inside the flange member.

The invention has for its object to improve a cover of the type described in the preamble such that the content of a comparatively upright positioned storage holder can be vented without the content thereof, for instance an aggressive liquid, being able to escape to the outside.

The cover according to the invention is distinguished in that the circular part of the cover located inside the sealing ring is provided with a discharge opening which can be closed off from the container content by a pressure sensitive closing means arranged inside the cover.

In this way, when there is momentary overpressure in the container, this overpressure can be reduced by allowing gas to escape. In the case the container suddenly falls or is knocked over the discharge opening will be closed off by the closing means so that no liquid can flow outside via the discharge opening.

The closing means are preferably formed as a diaphragm fixed in position along the periphery having at least one passage opening and in each case a support covering the passage opening.

A particularly effective action is obtained if the support has a dome-like structure on which the diaphragm with the passage opening supports. The response time for opening of this passage opening as a consequence of the pressure in the container is hereby shortened considerably.

In accordance with one embodiment the dome-like support is a part of a dish-shaped insert piece. This results in considerable simplifying of the assembly of the different parts of the venting cover.

For a good, effective attachment of the diaphragm between cover body and insert piece it is recommended according to the invention that the circular body of the cover be formed with an annular flange at an interval from the cover flange member, whereby the dish-like insert piece is formed with an annular groove accommodating the flange.

The invention is further elucidated hereinafter with reference to the annexed drawing of an embodiment.

Figure 2:
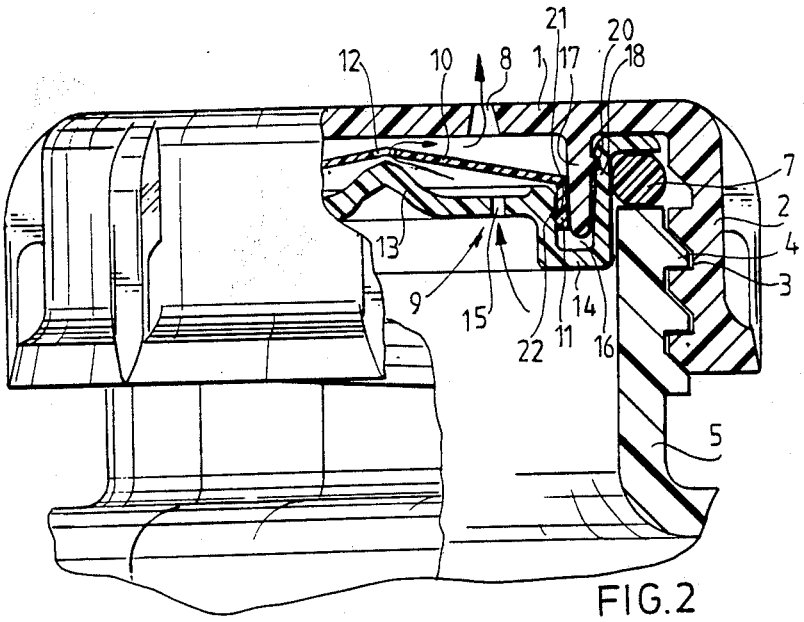

In the drawing:

FIGS. 1 and 2 each show a similar upright view of the cover according to the invention in respectively the closed and opened positions of the closing means.

The cover shown in the figures consists of a circular body 1 which is provided along the periphery with a cover flange member 2. This flange member is formed with an internal thread 3 which co-operates with a thread 4 on the outer periphery of a filling or dispenser spout 5 of a container 6 that is not further shown or described. Accommodated between the circular body 1 and the upper edge of spout 5 is a sealing ring 7 which, when the cover is screwed onto spout 5, is clamped in position so that a closed connection is effected between cover 1 and spout 5.

In accordance with the invention the circular body 1 of the cover is formed with a discharge opening 8. This discharge opening may have any random form and more than one thereof can moreover be arranged.

This discharge opening 8 can be screened off from the container contents and from the space inside spout 5 by closing means which are generally designated with 9.

The closing means consist substantially of a diaphragm 10 of thin sheet-like material which is flexible such that movement in axial sense is possible. The space between the cover 1 and the diaphragm 10 forms an ambient pressure chamber which communicates with ambient atmosphere through the vent opening 8 whereas the space between the diaphragm 10 and the spout 9 forms a secondary chamber which communicates with the interior of the container through the interior vent opening 15. Diaphragm 10 is formed with a downward hanging edge portion 11 which is fixed in position in a manner to be further explained below.

Diaphragm 10 is formed with a passage opening 12. This passage opening lies on the top of a dome-like support 13, which support forms a part of a dish-like insert piece 14.

The portion of the dish 14 located adjoining the dome-like support 13 is formed with a passage opening 15, only one of which is drawn, although it will be apparent that more than one can be arranged. The same applies to the passage openings 12, whereby more dome-like supports 13 can then be formed on dish 14.

The dish-like insert piece 14 is formed with an annular groove 16 in which is accommodated a downward hanging flange 17, which is likewise annular and is moulded on the underside of the circular part 1 of the cover.

The dish-like part 14 is formed in addition with an edge portion 18 extending along flange 17 which then continues along the outer periphery as a radially protruding flange 19. Arranged between flange 17 and edge portion 18 is a snap coupling in the form of a tongue/-groove connection 20.

The downward hanging edge portion of diaphragm 10 is likewise provided with a tongue 21 which co-operates with a groove 22 in the internal wall part of the groove 16.

Assembly of the parts of the above described venting cover takes place as follows.

The diaphragm 10 is placed on insert piece 14 such that the edge strip 11 enters groove 16 and is pressed on until tongue 21 falls into groove 22. The dome-like support 13 is hereby directed toward diaphragm 10. The inserted piece is then shapped into position in the cover, whereby the snap coupling 20 ensures a permanent attachment. Finally, the sealing ring 7 is fitted and the cover is ready for use. The cover 1 and the insert means 9 which includes the pressure-sensitive means 10 are in snap-fitted relation to form a unit which can be removed as such a unit by unscrewing the cover 1 so that contents of the container may be poured as desired. When the container is once again to be sealed, the sealing ring 7 is fitted in place and the unit screwed back on the container.

When the insert piece 14 is fitted the dome-like support 13 will bias diaphragm 10 in the direction of the circular body 1 of the cover and therefore place it under tension. Passage opening 12 is sealed off by support 13. A completely closed off spout 5 will therefore result when the cover is screwed onto spout 5, on the one side as a result of sealing ring 7 and on the other as a result of diaphragm 10, the edge strip 11 of which lies clamp in position between flange 17 and the inner wall of groove 16.

When overpressure occurs however the pressure will act via the passage opening 15 on the underside of diaphragm 10, which diaphragm 10 will be fitted at a determined overpressure from dome-like support 13, which will result in the release of passage opening 12, see FIG. 2. The gas under pressure will immediately flow away via this passage opening 12 and discharge opening 8 to the outside. As soon as a balance has been established diaphragm 10 returns to the starting position as in FIG. 1 and the opening 12 is closed off.

It will be apparent that there is no possibility in the case of underpressure that gases can enter into the storage holder from outside, because the diaphragm 10 is pressed permanently in position on dome-like support 13 and does not therefore release the passage opening 12.

The invention is not limited to the above described embodiment.

I claim:

1. A cover for a filling or dispenser spout of a storage holder, such as a liquid container, which cover consists of a circular body having arranged along the periphery thereof a cover flange member provided with fastening means adapted to cooperate with said spout, a sealing ring fitted inside said cover flange member, part of said cover located inside said sealing ring being provided with a discharge opening, and pressure sensitive closing means also fitted inside said cover flange member and including plural passage opening means therethrough to communicate the discharge opening with the container content in the pressure of overpressure in the container and to close off the container content from the discharge opening in the absence of overpressure in the container, the closing means being formed as a diaphragm clamped in position along the periphery having at least one passage opening and a support covering said passage opening.

2. Cover as claimed in claim 1, characterized in that the support has a dome-like structure.

3. Cover as claimed in claim 2, characterized in that the dome-like support is a part of a dish-shaped insert piece.

4. Cover as claimed in claim 3, characterized in that the insert piece is connected to the cover via a snap coupling.

5. Cover as claimed in claim 3, characterized in that the body of the cover is provided with an annular flange at an interval from the cover flange member, whereby the dish-like insert piece is provided with an annular groove accommodating said flange.

6. A venting cover assembly comprising the combination of a cover having a vent opening therein and provided with means for securing the cover in sealing association with a spout of a container, insert means for forming an ambient pressure chamber with the cover which communicates with ambient atmosphere through the vent opening, the insert means including an interior vent opening communicating the interior of the container with a secondary chamber through the interior vent opening, and pressure-sensitive means separating the ambient pressure chamber from the secondary chamber and responsive to pressure greater than ambient pressure for communicating the secondary chamber with the ambient pressure chamber.

7. A venting cover assembly as defined in claim 6 wherein the insert means includes a dome-like portion and the pressure-sensitive means includes an opening seated upon the dome-like portion to tension the pressure-sensitive means and form a one-way valve communicating the secondary chamber with the ambient pressure chamber.

8. A venting cover assembly as defined in claim 7 wherein the cover, the insert means and the pressure-sensitive means form a unit.

9. A venting cover assembly comprising the combination of a cover having a top provided with a vent opening and a pair of concentric flanges including a periphery flange having an inner side provided with means for securing the cover in sealing association with a spout of a container and an inner flange, an insert assembly frictionally fitted with the cover so as to form a unit with the cover which may be removed from the container to allow container content to be poured therefrom and then replaced in sealing relation on the container, the insert assembly including insert means having a trough receiving the inner flange and frictionally fitted therewith and pressure-sensitive means frictionally fitted within the trough for forming an ambient pressure chamber between the cover and the pressure-sensitive means which communicates with ambient atmosphere through the vent opening and a secondary chamber between the pressure-sensitive means and the insert means, the insert means including an interior vent opening communicating the interior of the container with the secondary chamber through the interior vent opening, and the pressure-sensitive means being tensioned by the insert means to respond to pressure greater than ambient pressure within the container for communicating the secondary chamber with the ambient pressure

10. A venting cover assembly as defined in claim 9 wherein the pressure-sensitive means includes a resilient diaphragm portion within the inner flange and provided with a further vent opening, and the insert means including a localized portion seated on the further vent opening and tensioning the diaphragm portion to form a check valve venting the interior of the container only in the direction of the ambient pressure chamber.

* * * * *